US005121606A

United States Patent [19]

Schukey

[11] Patent Number: 5,121,606

[45] Date of Patent: Jun. 16, 1992

[54] THERMODYNAMIC CYCLIC PROCESS

[75] Inventor: Jürgen Schukey, Hamburg, Fed. Rep. of Germany

[73] Assignee: SITA Maschinenbau- und Forschungs GmbH, Hamburg, Fed. Rep. of Germany

[21] Appl. No.: 622,365

[22] PCT Filed: Jun. 11, 1987

[86] PCT No.: PCT/EP87/00306

§ 371 Date: Dec. 9, 1988

§ 102(e) Date: Dec. 9, 1988

[87] PCT Pub. No.: WO87/07676

PCT Pub. Date: Dec. 17, 1987

Related U.S. Application Data

[63] Continuation of Ser. No. 294,560, Dec. 9, 1988, abandoned.

[30] Foreign Application Priority Data

Jun. 12, 1986 [DE] Fed. Rep. of Germany ..... 3619749

[51] Int. Cl.[5] ..... F01K 25/06

[52] U.S. Cl. ..... 60/649; 60/673

[58] Field of Search ..... 60/649, 673

[56] References Cited

U.S. PATENT DOCUMENTS

| | | | |
|---|---|---|---|
| 4,009,575 | 3/1977 | Hartman et al. | 60/673 |
| 4,085,590 | 4/1978 | Powell . | |
| 4,262,739 | 4/1981 | Gruen et al. | 60/673 X |
| 4,397,153 | 8/1983 | Terry . | |
| 4,537,031 | 8/1985 | Terry et al. | 60/673 X |
| 4,701,199 | 10/1987 | Kabe et al. | 165/104.12 |
| 4,712,610 | 12/1987 | Kesten et al. | 60/649 X |

FOREIGN PATENT DOCUMENTS

| | | |
|---|---|---|
| 2345420 | 4/1975 | Fed. Rep. of Germany . |
| 1395738 | 3/1965 | France . |
| 2400676 | 3/1979 | France . |
| 57-28818 | 2/1982 | Japan . |
| 2017226 | 10/1979 | United Kingdom . |

*Primary Examiner*—Allen M. Ostrager
*Attorney, Agent, or Firm*—Chilton, Alix & Van Kirk

[57] ABSTRACT

A thermodynamic cyclic process with a gaseous working medium, which is alternately compressed and expanded, in which process a working medium is employed, which experiences a volume expansion due to chemical processes at the higher temperature after the compression and a corresponding volume contraction at the lower temperature after the expansion, is to be improved so that a higher efficiency is achieved. This is achieved in that the volume contraction is endothermic. In this case, the cyclic process can increase the efficiency both in heat engines and also in heat pumps.

20 Claims, 4 Drawing Sheets

1
2
3
4
5
6
7
8
9
10
11
12
13
14
20
G
M 13
14
11
12
21
5
6
1
10
20
7
8
9

THERMODYNAMIC CYCLIC PROCESS

This is a continuation of copending application Ser. No. 07,294,560 filed on Dec. 9, 1988 now abandoned.

The invention relates to a thermodynamic cyclic process with a gaseous working medium which is alternately compressed and expanded, in which process a working medium is employed, which experiences a volume expansion due to chemical processes at the higher temperature after the compression and a corresponding volume contraction at the lower temperature after the expansion.

In cyclic processes there exists, quite generally, the problem that they have a limited efficiency. This efficiency is, on the one hand, given by physical laws, but on the other hand, also determined by constructional details. Thus, for technical reasons, it is in most cases only possible to operate these devices with a relatively low efficiency.

A certain increase in the efficiency is to be aimed at in a process of the initially mentioned type (UK-A2,017, 226). In the cyclic process described therein, for the generation of energy, the thermal energy which is supplied is not only employed for expanding the gas due to the heating in the conventional manner. Rather, further heat is expended in order to liberate further gas on account of an endothermic chemical process, i.e. to bring about a further volume expansion. The advantage that more working gas is obtained at the higher temperature is, however, counteracted by the disadvantage that more heat is also given off to the colder heat reservoir in the course of the corresponding exothermic volume contraction at the lower temperature of the circuit.

The object of the invention consists in providing a cyclic process of the initially mentioned type, which process has a very high efficiency.

The object is achieved, according to the invention, in that the volume contraction is endothermic.

In contrast to the previously known cyclic process, there is thus no need for additional energy to be expended in order to obtain the additional gas. Rather, the appropriate chemical processes involved in the formation of the additional gas at the higher temperature are exothermic, so that these processes run automatically, as soon as the gas has actually been brought to the appropriate temperature. Thus, in a heat engine less heat needs to be supplied at the higher temperature, whereby the efficiency is increased. On the other hand, less energy also needs to be given off to the heat reservoir of lower temperature at the lower temperature, since the corresponding volume contraction is endothermic, which leads to a further increase in the efficiency. It is even feasible that, in this case, heat is absorbed from the environment at the lower temperature.

If the cyclic process is employed for a heat pump, then there is likewise an increase in the efficiency. In the heat pump, heat is withdrawn from a temperature reservoir of lower temperature and given off, by means of mechanical energy, to a temperature reservoir of higher temperature. Because of the endothermic chemical volume contraction, more heat is absorbed at the lower temperature from the environment. With an equal quantity of mechanical energy to be expended, more heat is therefore gained, and the efficiency therefore rises.

One possibility for implementing the cyclic process would be, for example, to employ a molecular gas, the molecules of which decompose at the higher temperature into individual components, in the extreme case into individual atoms. Another possibility consists, as will be stated below, in heating a metal powder which absorbs or has adsorbed a gas.

Because of the fact that the working medium occupies a greater volume at the higher temperature, the gas is able to perform more work than would otherwise be the case. At the lower temperature, the chemical reaction and/or the desorption processes then proceed in the other direction, i.e. as absorption or adsorption processes, so that the gas again occupies its normal volume and is then once again available for the cycle.

Since the working medium employed is one which heats up in the course of the volume expansion at the higher temperature, in the case of a heat engine the quantity of heat supplied can be kept very small. This signifies a considerable saving of energy.

In an advantageous embodiment, the chemical process is an adsorption/desorption process.

In a particularly advantageous embodiment, in this case the adsorption/desorption of at least a part of the gaseous working medium takes place at surfaces which are alternately brought into contact with the gas at the higher and the lower temperature.

The surfaces may be disposed on a circular disc, which extends into the gas volumes of higher and lower temperature and is rotated. The disc could, for example, consist of a plurality of sectors, the gas of higher temperature then flowing through sectors, for example, above the axis of rotation, while the gas of lower temperature flows through sectors below the axis of rotation. In this case, it must, of course, be ensured by means of appropriate sector walls that, in this case, the gas of higher pressure does not flow through simultaneously over or through the circular disc to the region of lower pressure of the cyclic process.

Instead of this embodiment, it can also be provided—which has likewise proved to be advantageous—that the working medium consists of two components, which do not react with one another chemically and one of which is a normal gas and the other of which experiences the volume expansions/volume contractions due to chemical reactions and/or desorption processes. Both types of chemical reactions can, of course, also be combined with one another.

In a mixture of two components, the working gas which does not participate in the chemical reactions has the function of serving as transport means for quantities of heat and/or a metal powder which is guided round together with the gas in the circuit and at which the adsorption/desorption takes place.

Both in the cases in which the metal causing the adsorption/desorption is disposed on a disc and also in the cases in which the metal is guided along in the form of a powder in the gas stream, the gas can be hydrogen. Platinum, palladium or other catalyst metals which can absorb hydrogen can be employed as the metal.

If the cyclic process is employed for a heat engine, then it can advantageously be further provided that the expansion engine is connected to an electrical generator. This generator then delivers electrical energy in place of mechanical energy. At least a part of the heat energy for the heating vessel can, in this case, be delivered by the generator. In particular in circumstances in which the gas is very intensely heated in the course of the volume expansion due to chemical reactions and/ or desorption processes, it would even be possible to endeavour to have the heat energy delivered entirely by the electrical generator. In many other cases it will, however, be simpler to use, for this purpose, heat sources which are already in existence.

Advantageously, furthermore, the parts of the circuit of the working medium are provided with surfaces which promote or intensify the reactions leading to the volume expansions/volume contractions. In particular, the heating vessel and the heat exchanger or parts thereof can be provided with such surfaces.

The heat exchanger can undertake the heat exchange with the air of the environment. However, a heat exchange with a quantity of water is also possible; for this purpose, pumps must then be provided for the water, if required. However—and this can prove to be expedient in certain extreme situations—it is also possible, in order, for example, to avoid an excessively low temperature of the working medium in the heat exchanger, initially to compress the air which is conducted from outside via the heat exchanger, whereby that air is heated. The exhaust air can then be conducted via an expansion engine, so that the energy employed for increasing the pressure of the ambient air is regained, at least in part. In this way, the efficiency of the entire device can be increased further.

The invention is described in the text which follows, with the aid of an advantageous embodiment, with reference to the accompanying drawings. In the drawings.

Figure 1:
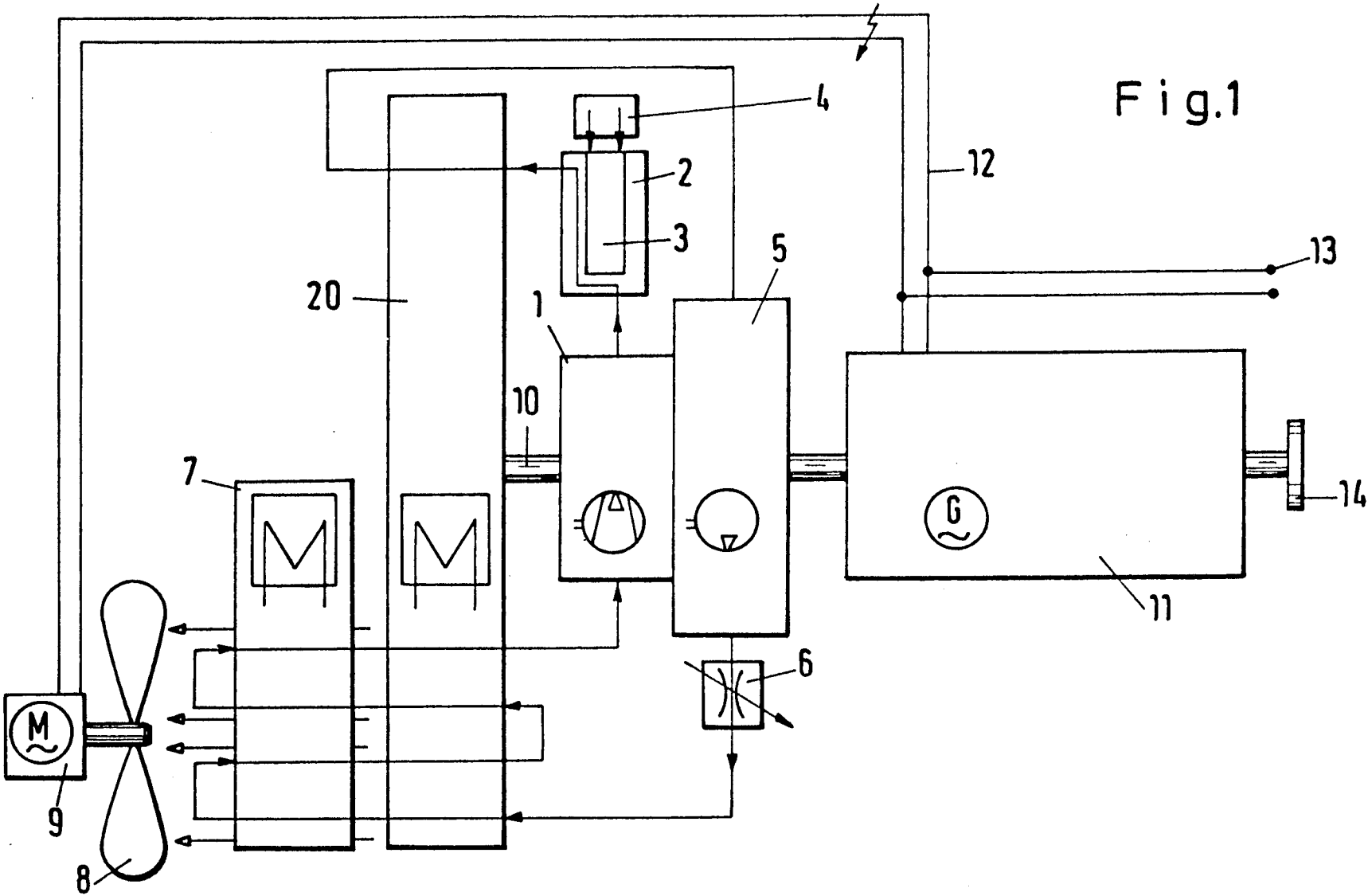
FIG. 1 shows, in a diagrammatic representation, the construction of a heat engine which operates in accordance with the cyclic process according to the invention.

In the engine shown in FIG. 1, the gaseous working medium is in the first instance compressed in a compressor 1, and then passes in the direction of the arrow into the heating vessel 2. This heating vessel contains a heating element, which is indicated at 3 and which is heated by a heat source 4. The heating element 3 could, of course, also be the outer wall of the vessel 2; in many cases, a separate heating element 3 will, however, be employed, for example in the case of electrical heating.

The working medium, already heated by the compression, is conducted through the upper part of a disc-shaped element 20, which is permeable to gas in the axial direction. On the other hand, however, a gas movement in the circumferential direction is very greatly obstructed, if not even made entirely impossible, by appropriate sectors on the disc-shaped element 20. Moreover, the disc-shaped element 20 is surrounded by a housing, so that all gas which is conducted into the disc-shaped element on one side actually flows out again on the other side. The disc-shaped element is now provided with a finely divided powder, onto which hydrogen gas is adsorbed. The metal powder can, for example, in finely divided form, be disposed on a silicone foam. Metal powders which are particularly suitable in this case are those which cool down to a particular extent in the course of the adsorption of hydrogen and heat up in the course of the desorption of the hydrogen. Moreover, they should bind the greatest possible quantity of hydrogen.

Since the temperature of the gas is increased by the heat source 3, the hydrogen gas is now given off from the metal powder. Accordingly, more gas is available, which is expanded in the expansion engine 5 and thus does mechanical work. Moreover, as a result of the exothermic process, there is also a further heating of the working medium, which now consists of the original gas and hydrogen.

Downstream of the expansion engine 5, the expanded gas or other working media are conducted via a regulating valve 6 into a heat exchanger 7, in which the heat exchange with the environment takes place, so that the gas again adopts its original temperature.

In this process, the gas is conducted through the heat exchanger 7 many times. Previously and afterwards, it is conducted many times through the lower region of the disc 20. Since the disc 20 has meanwhile been rotated, the metal in this lower region is in the first instance free from hydrogen. At this point, the hydrogen is again adsorbed, and this takes place with simultaneous cooling of the working gas since the adsorption is endothermic. In this way, less energy is given off to the environment or, in the most favourable case, thermal energy is even absorbed from the environment. In this way, a very high efficiency is achieved.

Subsequently, the gas can then be compressed again in the compressor 1.

The heat exchange with the environment is also assisted by a ventilator 8, which is driven by a motor 9.

Compressor 1 and expansion engine 5 are disposed on a common shaft 10, so that the compressor, after a once-only start, can be driven by the circuit itself, i.e. by the expansion engine 5. The mechanical energy which is available in addition can be absorbed by a generator 11, a part of the electrical power of which is conducted via lines 12 to the motor 9 for the ventilator 8. Another part of the energy can be usefully withdrawn at 13. In addition to this, or in place of this, mechanical energy can also be extracted at 14 from the shaft 10.

In the figure, it is also shown that the shaft 10 also rotates the disc 20. In this case, however, the disc 20 will normally be rotated at a lower speed than the compressor 1, the expansion engine 5 and the generator 11. For this purpose, a reducing gear not shown in the figure will also be provided.

Figure 2:
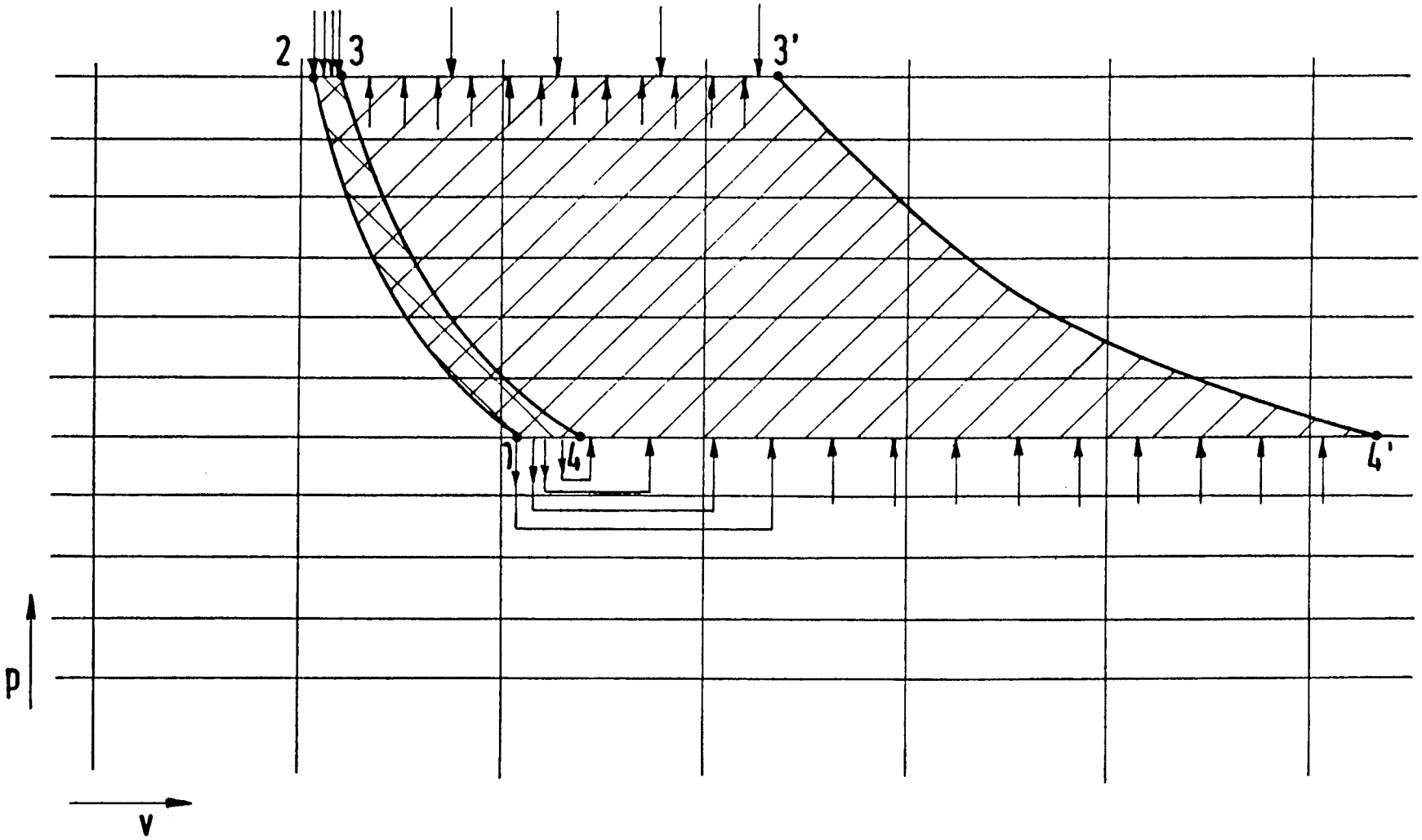
FIG. 2 shows a P/V diagram to explain the mode of operation of the engine of FIG. 1.

The mode of operation is now to be illustrated with reference to the diagram of FIG. 2. The original, hydrogen-free working medium is compressed in the compressor 1 in the portion 1-2 in the P/V diagram and passes into the heating vessel 2. In the heating vessel, heat is supplied to the gas through the heating element 3, whereby the volume is expanded while the pressure remains constant (portion 2-3 in the P/V diagram). Hydrogen gas is now released in the disc-shaped element 20, while energy is given off (portion 3-3' in the P-V diagram). At point 3' of the P-V diagram there is thus a working gas, which consists of the original gas (volume at point 3) and the hydrogen gas, which at point 3 in the first instance has a volume 0 and at 3' has its actual volume. The P-V diagram therefore shows the sum of the two gas volumes.

The original working medium and hydrogen are then expanded, in such a way as to do work, in the expansion engine 5 (portion 3'-4' in the P-V diagram); in this case, mechanical work is done.

Subsequently, the adsorption of the hydrogen gas then takes place in the low-pressure and low-temperature region of the disc-shaped element, with the absorption of heat (portion 4'-4 in the P-V diagram). Only the original working gas must then also be cooled (portion 4-1 in the P-V diagram). This heat can be absorbed, at least partially, by the endothermic process of the hydrogen adsorption. Subsequently, the gas has then again reached its original condition (point 1); the cyclic process can begin afresh.

Figure 3:
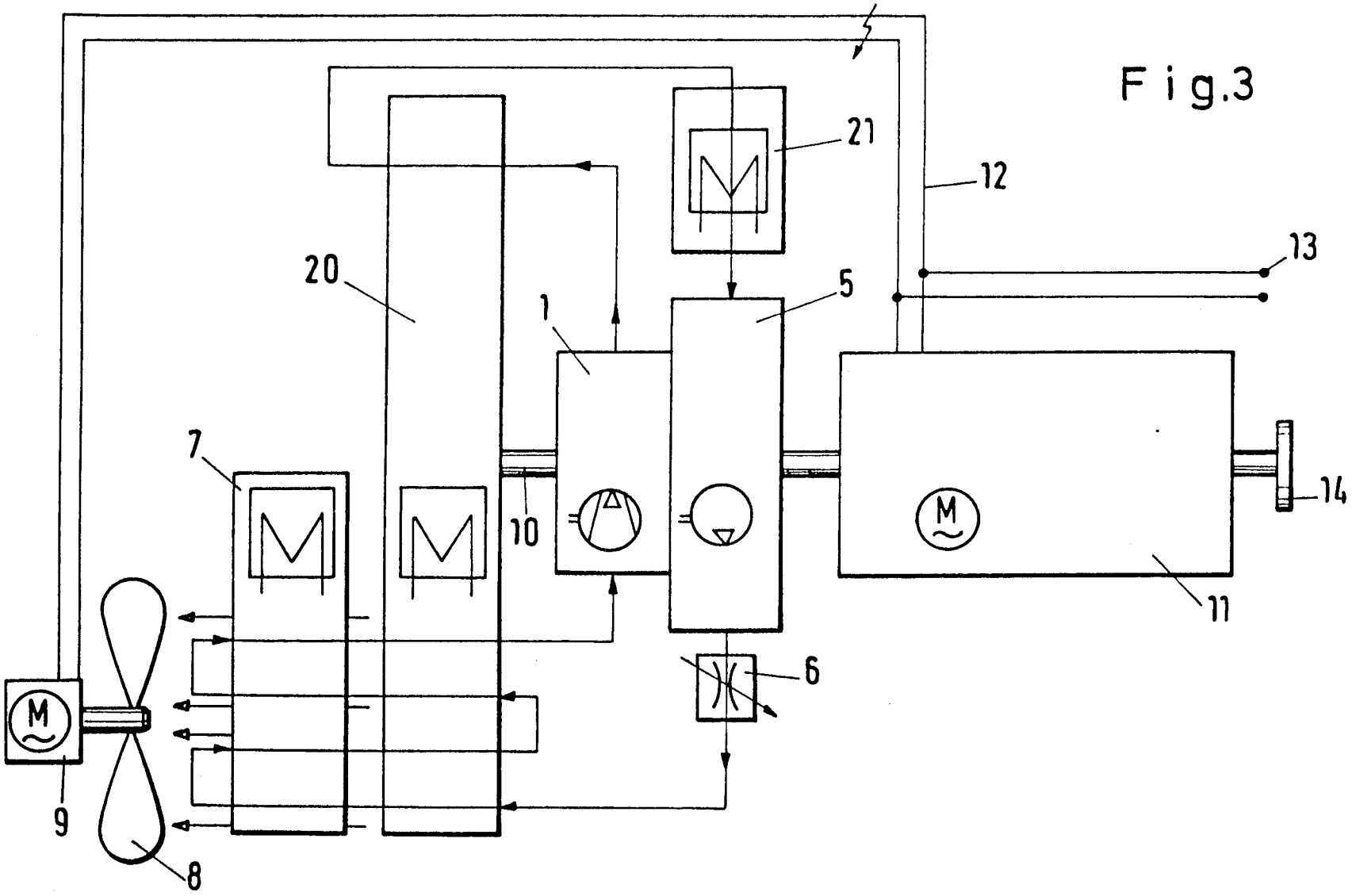
FIG. 3 shows, in a diagrammatic representation, the construction of a heat pump which operates by the cyclic process according to the invention.

FIG. 3 shows a heat pump which operates in accordance with the cyclic process according to the invention. In principle, the heat pump of FIG. 3 differs from the heat engine of FIG. 1 only in that, in place of the heating vessel 2, heating element 3 and heat source 4, a heat exchanger 21 is provided, by which a medium to be heated (for example the air in the room) is heated.

In operation, the shaft 10 of the heat pump of FIG. 3 is driven by electrical energy fed in at 13 by means of the motor/generator 11 or by mechanical energy applied at 14. The gas is compressed in the compressor 1 and thereby is heated. In the disc-shaped element 20, in consequence of desorption of hydrogen more gas is obtained. The heat is given off, in the heat exchanger 21, to the medium to be heated. After partial recovery of energy in the expansion engine 5, the hydrogen component of the gas is adsorbed in the lower part of the disc-shaped element 20 with the absorption of heat. Moreover, heat is absorbed at this point, since the gas cooled by the expansion must be heated again for the circuit. The corresponding heat is extracted from the environment in the heat exchanger 7.

Figure 4:
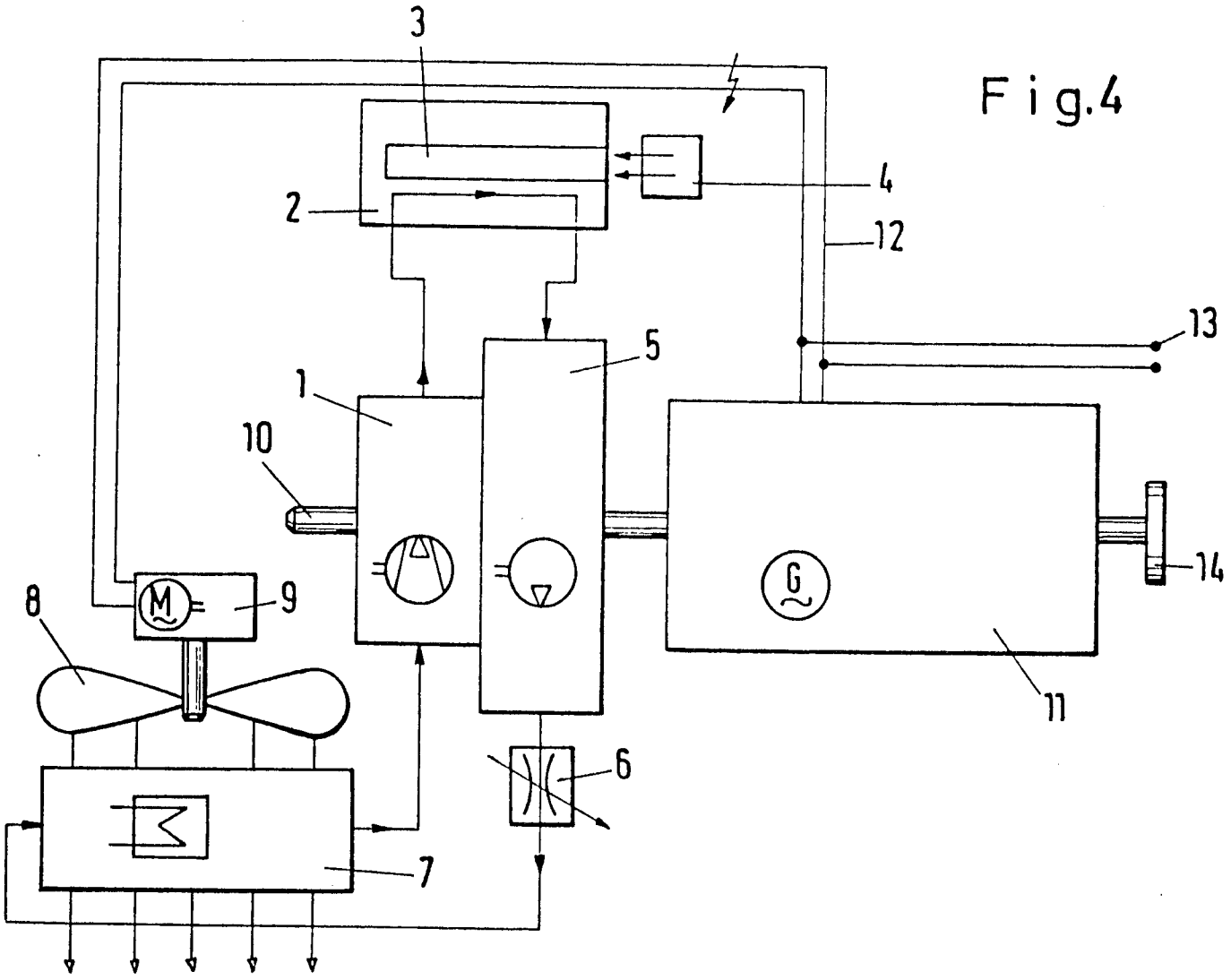
FIG. 4 shows another heat engine which operates in accordance with the process according to the invention.

In the heat engine shown in FIG. 4, the disc-shaped element 20 has been dispensed with. In place of this, a metal powder is entrained in the gas circuit. The exothermic desorption of hydrogen gas, accompanied by a volume expansion of the working medium, takes place, in this embodiment, in the heating vessel 2. Original, neutral working gas, hydrogen and metal powder are then also carried along in the circuit, until, in the heat exchanger 7, the hydrogen gas is again adsorbed by the metal powder in an endothermic process. However, the advantages of the exothermic and endothermic processes, as well as of the corresponding volume expansions and volume contractions continue to be obtained in their entirety. A disadvantage is simply that metal powder must be entrained in the working medium; this may lead to wear phenomena at the walls of the lines, of the compressor and of the expansion engine.

The amazing increase in the efficiency may also be explained by the fact that the hydrogen is 'compressed' in the course of the circuit without additional expenditure of energy by the adsorption, to the volume 0.

I claim:

1. A thermodynamic cyclic process with a gaseous working medium that is compressed with an associated temperature increase to a high temperature and secondarily expanded with an associated temperature decrease to a low temperature, the working medium experiencing a first volume expansion due to chemical processes resulting in an increase in the number of gaseous molecules at the high temperature after the compression but before the secondary expansion and a corresponding volume contraction due to a decrease in the number of gaseous molecules at the low temperature after the secondary expansion but before the compression, wherein an endothermic chemical process occurs during the volume contraction.

2. Cyclic process according to claim 1, characterized in that the chemical process is an adsorption/desorption process.

3. Cyclic process according to claim 2, characterized in that the adsorption/desorption of at least a part of the gaseous working medium takes place at reaction surfaces which are alternately brought into contact with a flow of the gas at the high and the low temperature.

4. Cyclic process according to claim 3, characterized in that the reaction surfaces are disposed on a circular disc which is rotated into the gas flow of high and low temperature.

5. Cyclic process according to claim 1, characterized in that a gaseous working medium is employed which consists of two components which do not react chemically with one another and one of which is a normal gas and the other of which experiences the first volume expansion and the endothermic volume contraction due to the chemical process.

6. Cyclic process according to claim 1, characterized in that a mixture of a gas and a powder is employed as the working medium which experiences the first volume expansion and the volume contraction due to the chemical process.

7. Cyclic process according to claim 6, characterized in that a metal powder is employed as the powder.

8. Cyclic process according to claim 5, characterized in that hydrogen is employed as the other component.

9. Cyclic process according to claim 1, characterized in that the cyclic process is operated so that the step of compressing includes heating the medium to the high temperature with mechanical energy and is preceded by the step of heating the medium by the cooling of a thermal reservoir of lower temperature.

10. Cyclic process according to claim 3, characterized in that the reaction surfaces are provided with surfaces which promote or intensity the chemical process.

11. Cyclic process according to claim 1, characterized in that, on a lowering of the temperature of the working medium below the ambient temperature, thermal energy is absorbed from the environment through a heat exchanger.

12. Cyclic process according to claim 1, characterized in that a mixture of two gases, at least one of which is synthetically produced and acts on the other in the manner of a catalyst, is employed as the working medium which experiences the volume expansion due to the chemical process.

13. Cyclic process according to claim 2, characterized in that a mixture of a gas and a powder is employed as the working medium which experiences the volume expansions due to chemical reactions and/or desorption processes.

14. Cyclic process according to claim 5, characterized in that a mixture of a gas and a powder is employed as the working medium which experiences the volume expansions due to chemical reactions and/or desorption processes.

15. A thermodynamic cyclic process which uses a gaseous working medium that is alternately compressed with an associated pressure and temperature increase and expanded with an associated pressure and temperature decrease, comprising the steps of:

(a) selecting a working medium that is in an inert state within a known, pressure-volume envelope of the process and which undergoes a first chemical process including expansion at a first known pressure-volume condition outside said envelope and undergoes an endothermic second chemical process including contraction to an inert state at a second known pressure-volume condition outside said envelope, the expansion including an increase in the number of gaseous molecules and the contraction including a decrease in the number of gaseous molecules;

(b) directing a flow of said working medium in a closed loop which includes a reference location where the medium is in a reference state within said envelope and at a reference temperature that is the minimum temperature of the cyclic process;

(c) compressing the working medium adiabatically from the reference state so that the temperature of the medium rises to a maximum value while the pressure and volume are within said envelope;

(d) after step (c), adding heat to the medium until the first chemical process occurs at said first condition outside the envelope, whereupon the medium experiences an expansion as a result of the chemical process;

(e) after step (d), extracting useful work by expanding the medium adiabatically to a maximum volume outside said envelope;

(f) after step (e), withdrawing heat from the medium until the second chemical process occurs at said second condition, whereupon the medium experiences a contraction to a pressure and volume condition within the envelope, as a result of the second chemical process;

(g) further cooling the medium to said reference state; and (h) cyclically repeating steps (c)-(g).

16. The cyclic process of claim 15, wherein the step of selecting a working medium includes selecting a medium which undergoes the first and second chemical processes by adsorption and desorption.

17. The cyclic process of claim 15, wherein the step of selecting a working medium includes selecting a medium which consists of two components which do not react chemically with one another and one of which is a normal gas and the other of which experiences the volume expansion and the endothermic volume contraction as a result of the chemical processes.

18. A thermodynamic cyclic process which uses a gaseous working medium that is alternately compressed with an associated pressure and temperature increase, and expanded with an associated pressure and temperature decrease, comprising the steps of:

(a) selecting a working medium that is in an inert state within a known, pressure-volume envelope of the process and which undergoes a first chemical process including expansion at a first known pressure-volume condition outside said envelope and undergoes an endothermic second chemical process including contraction to an inert state at a second known pressure-volume condition outside said envelope, the expansion including an increase in the number of gaseous molecules and the contraction including a decrease in the number of gaseous molecules;

(b) directing a flow of said working medium in a closed loop which includes a reference location where the medium is in a reference state within said envelope and at a reference temperature that is the minimum temperature of the cyclic process;

(c) compressing the working medium adiabatically from the reference state until the state of the medium is outside the envelope, whereupon the exothermic chemical process occurs and the medium experiences the maximum temperature of the cyclic process;

(d) after step (c), drawing away useful heat from the medium;

(e) after step (d), expanding the medium to the maximum volume of the cyclic process to perform useful work whereby the medium reaches the minimum temperature of the cyclic process in a state outside said envelope;

(f) after step (e), adding heat to the medium while the medium is contracting to the reference state as a result of the endothermic second chemical process; and (g) cyclically repeating steps (b)-(f).

19. The cyclic process of claim 18, wherein the step of selecting includes selecting a gaseous medium that undergoes an adsorption and desorption chemical process.

20. Cyclic process according to claim 1, wherein the working medium is compressed in a compressor, heated in a heating vessel, expanded in an expansion engine, and cooled in a heat exchanger which exchanges thermal energy with the environment.

* * * * *

UNITED STATES PATENT AND TRADEMARK OFFICE

CERTIFICATE OF CORRECTION

PATENT NO. : 5,121,606

DATED : June 16, 1992

INVENTOR(S) : Jurgen Schukey

It is certified that error appears in the above-indentified patent and that said Letters Patent is hereby corrected as shown below:

Column 6, line 3, claim 10, change " intensity" to --intensify --.

Signed and Sealed this

Eighth Day of February, 1994

Bruce Lehman

*Attest:*

BRUCE LEHMAN

*Attesting Officer*

*Commissioner of Patents and Trademarks*